United States Patent [19]

Bakgaard

[11] 4,180,706

[45] Dec. 25, 1979

[54] LOUDSPEAKER MOTIONAL FEEDBACK SYSTEM

[75] Inventor: Knud E. Bakgaard, Struer, Denmark

[73] Assignee: Bang & Olufsen A/S, Struer, Denmark

[21] Appl. No.: 792,554

[22] Filed: May 2, 1977

[51] Int. Cl.[2] ..... H04R 3/00

[52] U.S. Cl. ..... 179/1 F

[58] Field of Search ..... 179/1 F, 1 D, 1 J

[56] References Cited

U.S. PATENT DOCUMENTS

| | | | |
|---|---|---|---|
| 2,841,648 | 7/1958 | Thurston | 179/1 F |
| 3,009,991 | 11/1961 | Bekey | 179/1 F |
| 3,798,374 | 3/1974 | Meyers | 179/1 F |
| 3,889,060 | 6/1975 | Goto et al. | 179/1 F |

FOREIGN PATENT DOCUMENTS

| | | | |
|---|---|---|---|
| 2141141 | 2/1973 | Fed. Rep. of Germany | 179/1 F |

*Primary Examiner*—George G. Stellar
*Attorney, Agent, or Firm*—Hume, Clement, Brinks, Willian & Olds, Ltd.

[57] ABSTRACT

A sound reproduction system of the MFB-type (motional feedback), comprising an amplifier and a loud speaker system, the woofer of which is provided with a transducer producing in the lower frequency range a feedback signal proportional to the accelerations of the woofer membrane. The loudspeaker system is provided with a filter connected to the main signal input and designed so as to produce a reference signal in accordance with the expected ideal transfer function of the woofer and its associated crossover filter. This reference signal, alone or superimposed by the output signal of the amplifier, is fed to a comparator in which the reference signal is reduced by the transducer signal (or vice versa), whereby a differential signal is produced and fed to the amplifier as a feedback signal either directly, if it is already superimposed upon the amplifier output, or with addition of this output, whereby a very efficient and optimal feedback is obtained, tending to correct any deviation of the woofer operation, in amplitude or phase, from the ideal transfer function thereof. The respective amplifier and loudspeaker systems are usable in a compatible manner in connection with conventional respective loudspeaker and amplifier systems, so the invention also comprises separate audio signal producing apparatus and loudspeaker systems prepared for cooperation according to the invention.

59 Claims, 3 Drawing Figures

LOUDSPEAKER MOTIONAL FEEDBACK SYSTEM

This invention relates to a sound reproduction system of the MFB-type (motional feedback) comprising amplifier means and, connected therewith through a main signal wire, loudspeaker means including at least one driver equipped with a transducer producing an electric output signal substantially proportional to the acceleration of the driver membrane, and thus indicative of the real transfer function of the driver, said amplifier means being feedback controlled by means of a signal derived from said transducer output signal. In such system the loudspeaker performance in the lower frequency range is improved in several respects. Generally, as well known, the use of a feedback signal to an amplifier involves a stabilization of the function thereof, and when the signal is derived directly from the oscillating membrane of the driver, normally the woofer in a double or triple loudspeaker system, it is ensured that the amplifier is controlled so as to compensate for irregularities in the transfer function of the driver. The result is a low degree of harmonic distortion, a low operational low-frequency limit and a good stabilisation of the sound pressure as a function of the frequency.

The transducer output signal, however, is usable as a feedback control signal only in the lowermost frequency range (e.g. up to 600–1000 Hz), because at higher frequencies the woofer membrane does not oscillate as a rigid unit, i.e. with all portions thereof oscillating in an exactly uniform manner, and the use of the feedback correction system above the said lower frequency range, therefore, would be liable to involve miscorrections. In usual reproduction systems the amplifier feeds not only a woofer, but additionally a tweeter or both a midrange and a tweeter, and said miscorrections, therefore, would apply to both the woofer and the other driver or drivers. Therefore, in order to avoid the miscorrections in the said MFB-system it is normal practice to feed the woofer from a low frequency range amplifier and the other driver or drivers from a separate full range or upper range amplifier. The respective drivers and amplifiers should be closely adapted to each other, so normally it is necessary to provide the system not only with more than one amplifier, but generally as an integral unit including amplifiers and loudspeakers. Moreover, it is difficult to provide for an ideal feedback because the feedback signal as derived from the transducer is liable to cause some phase distortion.

From a commercial point of view it would be attractive if the advantages of the woofer feedback system were obtainable without using a special woofer amplifier and without the amplifier and the loudspeakers having to be made as an integrated unit, and it is the purpose of the present invention to provide a sound reproduction system which is improved both in these respects and with respect to the quality of the feedback control.

According to the invention the said reproducing system includes filter means connected to the amplifier output and designed so as to produce a reference signal in accordance with the desired total transfer function of the driver, and comparator means for comparing said reference signal with the transducer output signal and producing a differential signal in response to said reference and transducer signals deviating from each other, said differential signal superimposed by the output signal of the amplifier means being supplied as a feedback control signal to said amplifier means.

Principally the said filter means constitute an electric imitation of the driver with associated cross over filter means, if any, so as to represent the desired or correct transfer function of the driver, i.e. to produce an electric output signal which, for any frequency within the relevant frequency range, should correspond in phase and amplitude to the sound pressure to be produced by the driver membrane. This sound pressure is detected indirectly by said transducer, and as long as the output signals of the filter and the transducer are identical there will be no differential signal, and the amplifier will operate in conventional manner with its own output used as a feedback signal, the driver now operating in fully correct manner. If the membrane starts operating in incorrect manner the transducer signal will no longer be identical with the filter signal, and the resulting differential signal will be superimposed on the feedback signal and cause the amplification to be controlled so as to counteract the incorrectness. Thus, with this arrangement the feedback signal will be constant when the actual or real transfer function of the woofer unit corresponds to the desired or ideal transfer function thereof, and in case of deviations from the desired transfer function the feedback signal will be changed so as to tend to control the amplification in such a manner that the actual or real transfer function of the woofer unit is approximated to the desired or ideal function thereof. In the system according to the invention, therefore, something more than just a direct feedback stabilization of the woofer operation is obtained, viz. a stabilization governed by the desired or ideal transfer function of the woofer is obtained, whereby phase distortion will be eliminated or minimized.

Normally the loudspeaker system will comprise a crossover network serving to supply to the woofer only the low frequency range of the main signal while supplying the higher frequency range thereof to an additional midrange or tweeter of the loudspeaker system or unit. For frequencies higher than the crossover frequency of the said crossover network the sound pressure generated by the woofer is drastically reduced, and the output of the said transducer, therefore, is correspondingly reduced so that the feedback signal to the amplifier will practically be switched off for frequencies higher than the crossover frequency, whereby the said possible miscorrections will be avoided, and the amplifier may drive the loudspeakers of the loudspeaker system or unit in a fully conventional manner.

According to the invention, therefore, it is sufficient to use a single amplifier for both or all drivers in the loudspeaker unit, i.e. the amplifier system may be as in an ordinary radio, tape recorder or television set, though it should be prepared so as to be able to receive the said feedback signal, and the loudspeaker unit should be provided with the said reference signal producing filter means. In this manner the amplifier and the loudspeaker system need not be integral, and the system may be fully compatible in that the amplifier may drive an ordinary loudspeaker unit while on the other hand the loudspeaker system may be driven by an ordinary amplifier, of course without the advantages of the motional feedback operation.

The present invention, therefore, relates not only to the entire sound reproducing system, but naturally also to the audio signal producing apparatus and the separate loudspeaker system as defined in the appended claims, i.e. constituting separate articles of sale prepared specifically to meet the requirements of the combined operational system according to the invention.

The invention is described in more detail in the following with reference to the accompanying drawing, in which.

Figure 1:
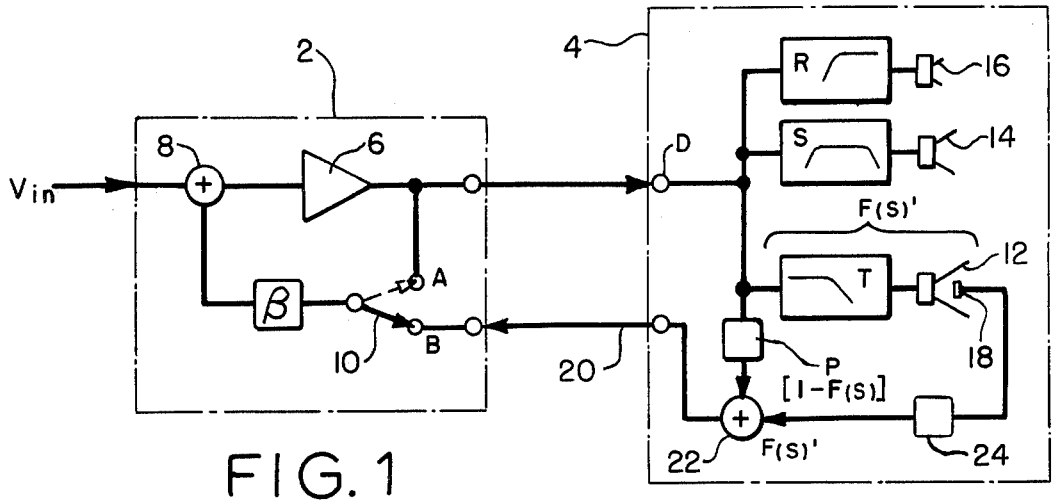
FIG. 1 is a schematic diagram of a feedback system according to the invention.

In FIG. 1 the amplifier unit is designated 2 and the loudspeaker system as a whole 4. The amplifier itself is designated 6, and it receives an input signal $V_{in}$ through an adder circuit 8 to which an ordinary feedback signal may be applied from the amplifier output through a reduction network $\beta$ and through a switch over switch 10, position A. The speaker system 4 includes a woofer 12, a midrange 14 and a tweeter 16, all provided in the usual manner with respective crossover networks R,S and T connected in common to the output of the amplifier. The system so far described operates in a fully conventional manner.

The woofer 12 is provided with a transducer 18 producing an output signal as a function of the accelerations of the woofer membrane and connected through a separate wire 20 to another terminal B of the switch 10, whereby the switch may be positioned so as to feed the transducer signal as a feedback signal to the amplifier 6. A filter P is connected to the common input terminal D of the loudspeaker system and provides an output signal to an adder network 22 in the transducer wire 20.

The filter P is designed so as to have a transfer function which is a constant represented by the numeral one minus the desired total transfer function of the woofer system (woofer plus crossover network T), i.e. $1-F(s)$. The real transfer function $F(s)'$ of the woofer is sensed by the transducer 18, and in the adder network 22 the $F(s)'$ signal is combined with the $1-F(s)$ signal produced by the filter P, whereby the total feedback signal through the wire 20 and the switch 10, position B, will be a constant plus (or minus) the difference between the signals representing $F(s)$ and $F(s)'$, respectively, as given by the expression $(1-F(s))+F(s)'=1+\Delta F(s)$. Thus, the combined feedback signal to the terminal B of the switch 10 will be correct and independent of the frequency in the entire relevant frequency range, and both the transducer signal and the filter signal are automatically suppressed as the frequency rises beyond the crossover point between the woofer and the midrange (or tweeter, if no midrange is used). It may be necessary, of course, to provide for special impedance elements in the output wires of the filter P and/or the transducer 18 in order to obtain equal amplitudes of the respective output signals.

The amplifier and the element or set in which it is incorporated is very easy and inexpensive to adapt to the present system, and since as mentioned it is well suited to drive even a conventional simple loudspeaker system, with the switch 10 in position A, it may well be chosen to manufacture said elements or sets in such a manner that they are as a standard prepared for operation with the present system, and the invention, of course, will comprise such sets as well as loudspeaker units including the special filter means, whether or not the units, when in use, are driven in MFB-operation. In case of an integral system, of course, the filter P may be located in the amplifier unit directly between the output and the network $\beta$.

The reducer network $\beta$ causes the feedback signal to be reduced for obtaining the desired total amplification. It is possible to use a special filter for defining, if desired in an adjustable manner, the lower cutoff frequency of the woofer.

While the transducer output signal is not normally accurate enough to be used for the feedback control for frequencies above approximately 500–1000 Hz ($f_T$) the woofer may well under circumstances be usable for reproducing sound up to a somewhat higher frequency, e.g. 2000 Hz ($f_C$). In the system described above the fall off of the transducer signal is conditioned by the crossover frequency $f_C$ being reached, but according to a further aspect of the invention it is in fact possible to make use of a crossover frequency higher than said $f_T$. To that end it will be sufficient to mount in the output wire from the transducer a cutoff filter 24 designed so as to cut off the transducer signal at the frequency $f_T$. The transfer function of this filter being G(s) the filter P should then be designed to have the transfer function $(1-F(s))G(s)$.

Figure 2:
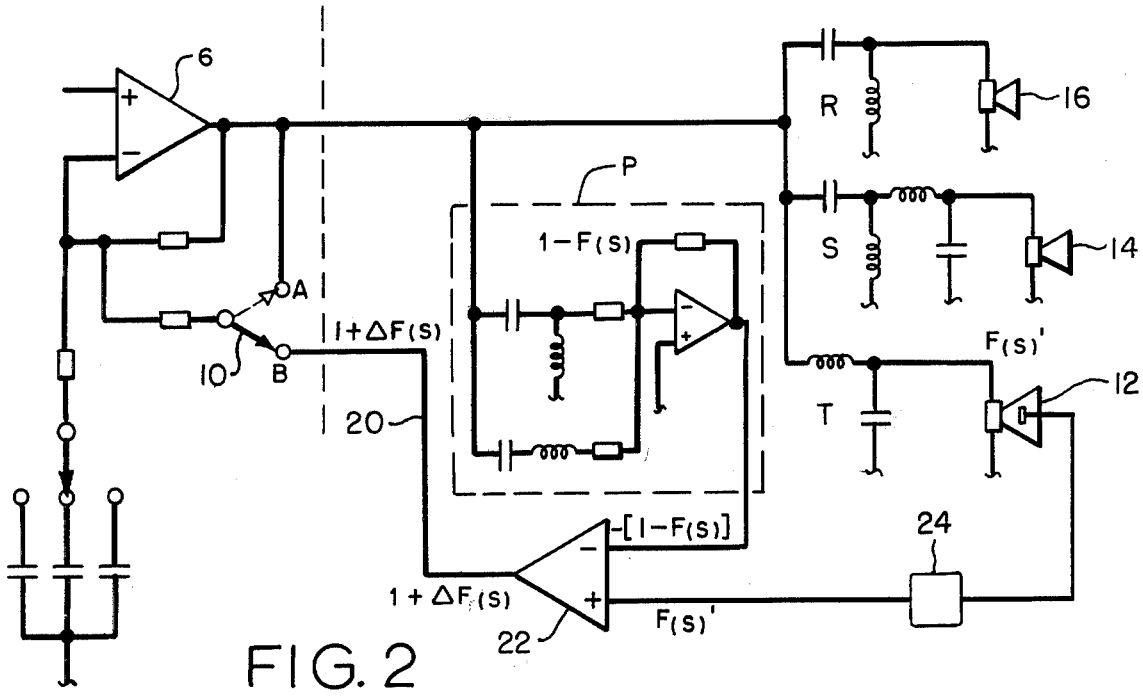
FIG. 2 is an example of the circuitry used therein.

A practical circuit of the system shown in FIG. 1 is schematically illustrated in FIG. 2, which is deemed to need no specific explanation to those skilled in the art.

Figure 3:
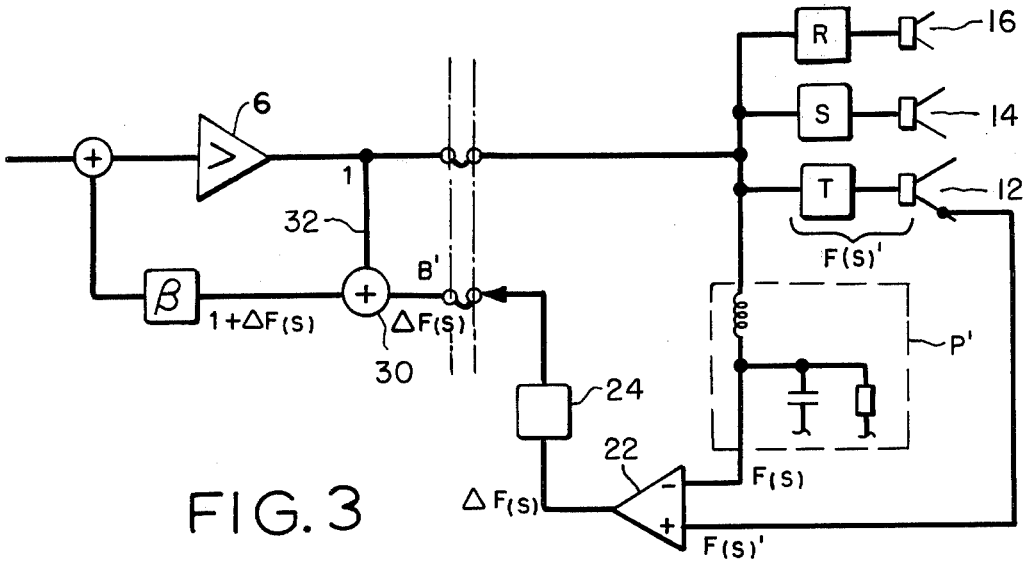
FIG. 3 is a schematic diagram of a modified, preferred system.

FIG. 3 illustrates a simplified arrangement in which the switch 10 in the amplifier system 2 is replaced by an adder circuit 30 and in which the filter P' is designed so as to electrically imitate the woofer with associated crossover network, i.e. so as to show the transfer function F(s). In this case the output from the comparator circuit 22 will be $\Delta F(s)$ only, but the main signal representing the numeral one in the final feedback signal $1+\Delta F(s)$ is supplied to the adder 30 directly from the amplifier output through a wire 32 which is thus provided as a stationary connection inside the amplifier unit, enabling the unit to work with or without motional feedback, depending upon whether or not a feedback wire from the loudspeaker unit is connected to the terminal B'.

The filter P' principally corresponds exactly to the crossover filter T of the woofer with addition of circuitry means imitating the woofer itself. Thus, the filter signal might as well be derived from the output terminal of the crossover filter T, but in practice the crossover filter normally includes circuitry for correction of certain reproduction errors of the woofer, and the signal, therefore, would not represent the relevant part of the total transfer function in any exact manner. However, if the woofer is of very high quality and thus requires practically no special correction it will in fact be possible to use its crossover filter in lieu of the filter P'. Unless the driver is of extremely high quality it should still be preferred to provide in the connection between the filter T and the negative input to the comparator 22 a circuit showing the desired transfer function of the woofer itself. In practice this circuit could not in any advantageous manner be substituted by the woofer itself, because the ideal transfer function would then be defined partly by an element constituting a source of incorrectness in said function.

In the extreme case of a single full range driver with no crossover network the filter signal to the comparator 22 may simply be the output signal of the amplifier, but still it should be preferred to include in the connection a transfer filter imitating the transfer function of the driver itself. Also the cutoff filter 24 should be provided for making the transducer 18 operative in the low frequency range only.

In the system illustrated in FIG. 3 the cutoff filter 24 is provided in the output wire of the comparator, this being possible generally when the comparator is adapted to produce a differential signal F(s) only and the main feedback signal from the amplifier is added to the output of the comparator.

The signal $1-F(s)$ as produced by the filter P in FIGS. 1 and 2 may alternatively be derived as a sum signal from the outputs of the crossover filters of the midrange and the tweeter, provided the system is a so-called phase linear system in which the drivers operate in an almost ideal manner. It will readily be understood that when the transfer function of the woofer is F(s) the total transfer function of the other driver or drivers in the system will be $1-F(s)$.

The feedback wire 20 may be used additionally as a power supply wire for a low power amplifier in the filter or comparator means in case active circuits are used.

What is claimed is:

1. A sound reproduction system of the MFB (motional feedback) type comprising amplifier means for providing an amplifier output and loudspeaker means connected to the output of the amplifier and including at least one driver equipped with a transducer producing an output signal substantially proportional to the acceleration of the driver membrane and thus indicative of the real transfer function of the driver, said amplifier means being feedback controlled by means of a signal derived from said transducer output signal, the sound reproduction system further including filter means connected to the amplifier output and designed so as to produce a reference signal in accordance with the desired total transfer function of the driver, and comparator means for comparing said reference signal with the transducer output signal and producing a differential signal in response to said reference and transducer signals deviating from each other, said differential signal superimposed upon the amplifier output being supplied to form a feedback control signal which is provided to said amplifier means.

2. A sound reproducing system according to claim 1 wherein said amplifier means comprises a full audio range amplifier, and wherein said loudspeaker means comprises crossover network means, a woofer and at least one additional driver.

3. A sound reproducing system according to claim 1, characterized in that said filter means is adapted to produce said reference signal superimposed upon the output signal of the amplifier means such that the output signal of the comparator is equal to said amplifier output signal plus said differential signal.

4. A sound reproducing system according to claim 1, characterized in that cutoff filter means are provided for causing the differential signal to be cut off at a predetermined operational maximum frequency of said transducer.

5. A sound reproducing system according to claim 4 wherein said cutoff filter means is operative on said transducer signal for cutting off said transducer signal at the predetermined operational maximum frequency of said transducer.

6. A sound reproducing system according to claim 4 wherein said cutoff filter means is operative on said differential signal for cutting off the differential signal at the predetermined operational maximum frequency of said transducer.

7. A sound reproducing system according to claim 1 wherein said amplifier means comprises a conventional amplifier operable to feed a conventional loudspeaker system in the entire frequency range and operable to accept as said feedback control signal a feedback signal having a transfer function defined by the expression $1-\Delta F(s)$, wherein $\Delta F(s)$ represents the transfer function of said differential signal.

8. A sound reproducing system according to claim 7 wherein said comparator means provides said feedback signal having a transfer function defined by the expression $1-\Delta F(s)$.

9. A sound reproducing system according to claim 8 further including switch means operable to selectively apply as a feedback control signal to said amplifier said amplifier output or said feedback signal having a transfer function defined by the expression $1-\Delta F(s)$.

10. A sound reproducing system according to claim 7 wherein said comparator means provides an output signal having a transfer function represented by $\Delta F(s)$, and further including adder means responsive to said comparator output and said amplifier output for providing said feedback signal having a transfer function defined by the expression $1-\Delta F(s)$.

11. A sound reproducing system according to claim 10 further including switch means operable to selectively apply as a feedback control signal to said amplifier said amplifier output or said feedback signal having a transfer function defined by the expression $1-\Delta F(s)$.

12. A sound reproducing system according to claim 7, further including switch means operable to selectively apply as a feedback control signal to said amplifier said amplifier output or said feedback signal having a transfer function defined by the expression $1-\Delta F(s)$.

13. A sound reproducing system according to claim 1 characterized in that the reference signal produced by the filter means has a transfer function equivalent to the transfer function of the driver, such that the output signal of said comparator is only a pure differential signal.

14. A sound reproducing system according to claim 13, in which the output of the comparator is coupled to said amplifier means through a cutoff filter operable to cutoff the differential signal at a predetermined relative maximum operational frequency of the transducer.

15. A sound reproducing system according to claim 1, in which the reference signal producing filter means are designed so as to produce a signal given by the expression $1-F(s)$ wherein F(s) is the desired transfer function of the driver equipped with said transducer, such that the output of the comparator is given by the expression $(1-F(s))\pm F(s)'=1+\Delta F(s)$, wherein $F(s)'$ is the actual transfer function of the driver equipped with said transducer.

16. A sound reproducing system according to claim 15, in which the transducer output is coupled to the comparator through a cutoff filter operable to cutoff the transducer signal at a predetermined relative maximum operational frequency of the transducer, said reference signal producing filter means being designed to have the transfer function $1-F(s)G(s)$, where G(s) is the transfer function of said cutoff filter.

17. A sound reproducing system according to claim 1 and including a woofer and at least one further driver and associated crossover filter means, the transducer being arranged in connection with the woofer, characterized in that said reference signal producing filter means includes said crossover filter means of the woofer for producing a reference signal having a transfer function defined by F(s), where F(s) is the desired transfer function of the woofer.

18. A sound reproducing system according to claim 1 wherein said loudspeaker includes a woofer, at least one additional driver, and individual crossover filter means associated with said woofer and each additional driver, and wherein said reference signal producing filter means includes a reference crossover filter means corresponding to the crossover filter means associated with said woofer for providing a reference signal having a transfer signal defined by $1-F(s)$, where F(s) is the desired transfer function of the woofer.

19. A sound reproducing system according to claim 1 including a woofer and at least one additional driver for reproducing a higher frequency range, and characterized in that said transducer is responsive to the woofer and that the woofer is connected to said amplifier means in parallel with the at least one additional driver.

20. A motional feedback sound reproduction system comprising:

amplifier means for producing an audio signal output;

loudspeaker means responsive to the output of the amplifier and having at least one driver speaker;

transducer means associated with and responsive to one of said at least one driver speaker for providing an output signal indicative of the output of the driver associated with said transducer means;

filter means responsive to the output of the amplifier and adapted to have a transfer function corresponding to the desired transfer function of the driver speaker associated with said transducer means, said filter means providing a reference signal which is a function of said transfer function; and comparator means responsive to said transducer output signal and said reference signal for providing a differential signal indicative of the difference between said transducer output signal and said reference signal, said differential signal being provided to the amplifier as a feedback signal.

21. The sound reproduction system of claim 20 wherein said loudspeaker means includes a woofer and at least one additional driver.

22. The sound reproduction system of claim 20 wherein the reference signal has a transfer function defined by the expression $1-F(s)$, wherein F(s) represents the desired transfer function of said driver speaker.

23. The sound reproduction system of claim 20 further including cutoff filter means for causing said differential signal to be cut off at a predetermined maximum frequency.

24. A sound reproduction system according to claim 23 wherein said cutoff filter means is operative on said transducer output signal.

25. A sound reproduction system according to claim 23 wherein said cutoff filter means is operative on said differential signal.

26. An audio signal producing apparatus for use in a motional feedback sound reproduction system having loudspeaker means and external feedback signal providing means, comprising:

amplifier means for providing an audio signal output to the loudspeaker means and operable to provide said audio signal output to a conventional loudspeaker system over the entire audio frequency range, said amplifier means further including feedback input means for receiving an external feedback signal;

feedback coupling means coupled between the feedback signal providing means and said feedback input means for providing to said amplifier means a feedback signal generated by the feedback signal providing means by differencing the measured output of the loudspeaker means with a signal which is a function of the desired output of the loudspeaker means, said feedback signal having a transfer function defined by the expression $1+\Delta F(s)$, wherein $\Delta F(s)$ is the transfer function of the difference between the output of the loudspeaker means and the desired output of the loudspeaker means.

27. The audio signal producing apparatus of claim 26 wherein said feedback coupling means receives from the feedback signal providing means an input signal having a transfer function defined by the expression $1+\Delta F(s)$, and transfers said input signal to said amplifier as said feedback signal.

28. The audio signal producing apparatus of claim 26 wherein said feedback coupling means receives from the feedback signal providing means an input signal having a transfer function defined by the expression $\Delta F(s)$, and wherein said feedback coupling means includes adder means responsive to said audio output signal and said input signal for providing to said amplifier said feedback signal having a transfer function defined by the expression $1+\Delta F(s)$.

29. The audio signal producing apparatus of claim 26 further including switch means selectively operable to provide to said feedback input means said audio signal output or said feedback signal.

30. A loudspeaker system for use in a motional feedback sound reproduction system having an audio amplifier, comprising:

a driver loudspeaker coupled to the output of the audio amplifier;

transducer means for providing an output signal indicative of the output of said driver loudspeaker;

filter means responsive to the output of said audio amplifier and adapted to have a transfer function which is a function of the desired transfer function of said driver loudspeaker, said filter means providing a reference signal in accordance with said transfer function; and comparator means responsive to said transducer output signal and said reference signal for providing a differential signal indicative of the difference between said transducer output signal and said reference, said differential signal being provided to the amplifier as a feedback signal.

31. The loudspeaker system of claim 30 wherein said driver loudspeaker comprises a woofer.

32. The loudspeaker system of claim 30 wherein said filter means simulates the transfer function of said driver loudspeaker, and wherein said differential signal includes only the difference between said reference signal and said transducer output.

33. The loudspeaker system of claim 32 further including a cutoff filter coupled between said comparator means and the amplifier and operable to cutoff said differential signal at a predetermined maximum frequency.

34. The loudspeaker system of claim 30 wherein said filter means provides a reference signal having a transfer function defined by the expression $1-F(s)$, wherein $F(s)$ represents the desired transfer function of said driver loudspeaker.

35. The loudspeaker system of claim 34 further including a cutoff filter coupled between said transducer means and said comparator means operable to cutoff the transducer output provided to said comparator at a predetermined maximum frequency.

36. The loudspeaker system of claim 30 wherein said filter means includes crossover filter means.

37. A sound reproduction system of the MFB (motional feedback) type comprising amplifier means for providing a full audio range amplifier output and loudspeaker means connected to the output of the amplifier and including first and second drivers for reproducing two different frequency ranges and a crossover filter means associated with said first driver, said first driver equipped with a transducer producing an output signal substantially proportional to the acceleration of the first driver membrane and thus indicative of the real transfer function of the first driver, said amplifier means being feedback controlled by means of a signal derived from said transducer output signal, the sound reproduction system further including filter means connected to the amplifier output and designed so as to produce a reference signal in accordance with the desired total transfer function of the first driver, and comparator means for comparing said reference signal with the transducer output signal and producing a differential signal in response to said reference and transducer signals deviating from each other, said differential signal superimposed upon the amplifier output being supplied to form a feedback control signal which is provided to said amplifier means.

38. A sound reproducing system according to claim 37 wherein said first driver is a woofer and wherein said reference signal producing filter means includes a reference crossover filter means corresponding to the crossover filter means associated with said woofer for providing a reference signal having a transfer signal defined by $1-F(s)$, where $F(s)$ is the desired transfer function of the woofer.

39. A sound reproducing system according to claim 37 wherein said first driver is a woofer and said reference signal producing filter means includes said crossover filter means associated with the woofer for producing a reference signal having a transfer function defined by $F(s)$, where $F(s)$ is the desired transfer function of the woofer.

40. A sound reproducing system according to claim 37, characterized in that said filter means is adapted to produce said reference signal superimposed upon the output signal of the amplifier means such that the output signal of the comparator is equal to said amplifier output signal plus said differential signal.

41. A sound reproducing system according to claim 37 in which the reference signal producing filter means are designed so as to produce a signal given by the expression $1-F(s)$, wherein $F(s)$ is the desired transfer function of the first driver such that the output of the comparator is given by the expression $(1-F(s)+F(s)'=1+\Delta F(s)$ wherein $F(s)'$ is the actual transfer function of the first driver.

42. A sound reproducing system according to claim 37 wherein said first driver is a woofer, said second driver operates in a higher frequency range than said woofer, and said first and second drivers are connected to said amplifier means in parallel.

43. A sound reproducing system according to claim 37 characterized in that the reference signal produced by the filter means has a transfer function equivalent to the transfer function of the first driver, such that the output signal of said comparator is only a pure differential signal.

44. A sound reproducing system according to claim 43, in which the output of the comparator is coupled to said amplifier means through a cutoff filter operable to cut off the differential signal at a predetermined relative maximum operational frequency of the transducer.

45. A sound reproducing system according to claim 37 wherein said amplifier means comprises a conventional amplifier operable to feed a conventional loudspeaker system in the entire frequency range and operable to accept as said feedback control signal a feedback signal having a transfer function defined by the expression $1-\Delta F(s)$, wherein $'\Delta F(s)$ represents the transfer function of said differential signal.

46. A sound reproducing system according to claim 45 further including switch means operable to selectively apply, as a feedback control signal to said amplifier, said amplifier output or said feedback signal having a transfer function defined by the expression $1-\Delta F(s)$.

47. A sound reproducing system according to claim 45 wherein said comparator means provides an output signal having a transfer function represented by $\Delta F(s)$, and further including adder means responsive to said comparator output and said amplifier output for providing said feedback signal having a transfer function defined by the expression $1-\Delta F(s)$.

48. A sound reproducing system according to claim 45 wherein said comparator means provides said feedback signal having a transfer function defined by the expression $1-\Delta F(s)$.

49. A motional feedback sound reproduction system comprising:

amplifier means for providing an audio signal output;

loudspeaker means responsive to the output of the amplifier and having at least two driver speakers for reproducing two different frequency ranges;

transducer means associated with and responsive to one of said at least two driver speakers for providing an output signal indicative of the output of the driver associated with said transducer means;

filter means responsive to the output of the amplifier and adapted to have a transfer function corresponding to the desired transfer function of the driver speaker associated with said transducer means, said filter means providing a reference signal which is a function of said transfer function; and comparator means responsive to said transducer output signal and said reference signal for providing a differential signal indicative of the difference between said transducer output signal and said reference signal, said differential signal being provided to the amplifier as a feedback signal.

50. The sound reproduction system of claim 49 wherein the reference signal has a transfer function defined by the expression $1-F(s)$, where $F(s)$ represents the desired transfer function of the driver speaker associated with said transducer means.

51. The sound reproduction system of claim 49 further including cutoff filter means for causing said differential signal to be cut off at a predetermined maximum frequency.

52. A sound reproduction system according to claim 51 wherein said cutoff filter means is operative on said transducer output signal.

53. A sound reproduction system according to claim 51 wherein said cutoff filter means is operative on said differential signal.

54. A loudspeaker system for use in a motional feedback sound reproduction system having an audio amplifier, comprising:

a crossover network;

first and second driver loudspeakers coupled to the output of the audio amplifier for reproducing two different frequency ranges;

transducer means for providing an output signal indicative of the output of said first driver loudspeaker;

filter means responsive to the output of said audio amplifier and adapted to have a transfer function which is a function of the desired transfer function of said first driver loudspeaker, said filter means providing a reference signal in accordance with said transfer function; and comparator means responsive to said transducer output signal and said reference signal for providing a differential signal indicative of the difference between said transducer output signal and said reference signal, said differential signal being provided to the amplifier as a feedback signal.

55. The loudspeaker system of claim 54 wherein said filter means provides a reference signal having a transfer function defined by the expression $1-F(s)$, wherein $F(s)$ represents the desired transfer function of said first driver loudspeaker.

56. The loudspeaker system of claim 55 further including a cutoff filter coupled between said transducer means and said comparator means operable to cut off the transducer output provided to said comparator at a predetermined maximum frequency.

57. The loudspeaker system of claim 54 wherein said first driver loudspeaker comprises a woofer.

58. The loudspeaker system of claim 54 wherein said filter means simulates the transfer function of said first driver loudspeaker, and wherein said differential signal includes only the difference between said reference signal and said transducer output.

59. The loudspeaker system of claim 58 further including a cutoff filter coupled between said comparator means and the amplifier and operable to cut off said differential signal at a predetermined maximum frequency.

* * * * *

UNITED STATES PATENT AND TRADEMARK OFFICE

CERTIFICATE OF CORRECTION

PATENT NO. : 4,180,706

DATED : December 25,1979

INVENTOR(S) : Knud E. Bakgaard

It is certified that error appears in the above—identified patent and that said Letters Patent is hereby corrected as shown below:

On the Title Page insert

-- [30] Foreign Application Priority Data

United Kingdom Apr. 30, 1976 17680 --.

Signed and Sealed this

*Thirteenth* Day of *May 1980*

[SEAL]

*Attest:*

SIDNEY A. DIAMOND

*Attesting Officer* *Commissioner of Patents and Trademarks*